US006568402B1

(12) United States Patent
Kaneki et al.

(10) Patent No.: US 6,568,402 B1
(45) Date of Patent: May 27, 2003

(54) MULTI-PLY CIGARETTE FILTER WRAPPER

(75) Inventors: Kazuyo Kaneki, Yokohama (JP); Takaichi Yoshida, Yokohama (JP); Keigo Miura, Yokohama (JP); Osamu Komatsubara, Yokohama (JP); Hideaki Katsumata, Fuji (JP); Hiroshi Hara, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 28 days.

(21) Appl. No.: 09/708,720

(22) Filed: Nov. 9, 2000

Related U.S. Application Data

(63) Continuation of application No. PCT/JP99/02430, filed on May 11, 1999.

(30) Foreign Application Priority Data

May 12, 1998 (JP) ..... 10-129026

(51) Int. Cl.[7] ..... A24D 1/04; D21H 27/00

(52) U.S. Cl. ..... 131/338; 131/360; 131/361; 131/365; 162/139

(58) Field of Search ..... 131/338, 361, 131/360, 335, 336, 341, 344, 365; 162/139

(56) References Cited

U.S. PATENT DOCUMENTS 4,002,178 A * 1/1977 Fiore et al. ..... 131/355
4,942,887 A * 7/1990 Abdelgawad et al. ..... 131/336
4,984,589 A * 1/1991 Riesdesser ..... 131/360
5,172,708 A * 12/1992 Drewett et al. ..... 131/336
5,464,028 A * 11/1995 Takeda et al. ..... 131/336
5,568,819 A * 10/1996 Gentry et al. ..... 131/331
6,095,152 A * 8/2000 Beven et al. ..... 131/194
6,202,650 B1 * 3/2001 Kaneki et al. ..... 131/335
6,289,898 B1 * 9/2001 Fournier et al. ..... 131/360

FOREIGN PATENT DOCUMENTS

| | | | |
|---|---|---|---|
| JP | A333299 | | 2/1991 |
| JP | A3151868 | | 6/1991 |
| JP | A104944 | | 1/1998 |
| JP | 11-103843 | * | 4/1999 |

* cited by examiner

*Primary Examiner*—Steven P. Griffin
*Assistant Examiner*—Carlos Lopez
(74) *Attorney, Agent, or Firm*—Birch, Stewart, Kolasch & Birch, LLP

(57) ABSTRACT

The cigarette filter wrapper paper has a paper layer which has a first surface and a second surface. The filter wrapper paper exhibits a first overlap air permeability, measured when a perforated tip paper is overlapped on the first surface, and a second overlap air permeability, measured when a perforated tip paper is overlapped on the second surface. The first overlap air permeability is higher than the second overlap air permeability.

11 Claims, 2 Drawing Sheets

MULTI-PLY CIGARETTE FILTER WRAPPER

CROSS-REFERENCE TO RELATED APPLICATIONS

This is a Continuation of Application PCT/JP99/02430, filed May 11, 1999.

This application is based upon and claims the benefit of priority from the prior Japanese Patent Application No. 10-129026, filed May 12, 1998, the entire contents of which are incorporated herein by reference.

BACKGROUND OF THE INVENTION

The present invention relates to a cigarette filter wrapper paper, cigarette filter and filter-tipped cigarette.

Recently, a tendency of favoring mild tobacco taste for tobacco products such as cigarettes has become increasingly stronger. To obtain mild tobacco taste, there are known a technique of expanding cut tobacco itself used for a cigarette to make the flavor or taste milder, and a technique of fitting a filter to the end of tobacco column of a cigarette.

In the latter technique of fitting the filter, in order to make tobacco flavor and taste still milder, it has been a practice that a filter body is composed of a plurality of filter sections, such as a so-called dual-filter, and activated carbon or the like is dispersed into the filter section constituting the mouth end portion. In addition, it has also been a practice that many ventilation holes are circumferentially made in a so-called tip paper which connects the filter body to the tobacco column integrally. The taste of the cigarette can be made milder by ambient air sucked through the ventilation holes when smoked. Furthermore, as a filter wrapper for wrapping a filter body, a paper sheet having a higher air permeability is also used.

However, when a filter wrapper having a high permeability is used, it may result in trouble while wrapping the filter plug since the strength of such a filter wrapper having a high permeability is low. Also, when such a filter wrapper is glued, the glue exudes from the filter wrapper to the conveyer belt, thus making it difficult to wrap filter plugs continuously. Further, when manufacturing a filter-tipped cigarette, a filter plug is sent to a cigarette-making machine by airblow. Here, when a filter wrapper having a high permeability is used, glue exudes out in the air blower unit for the filter plug, and the exuded-out glue is attached to an inside of the air blower unit. Later on, it peals off, and mixes into the filter plug, thus making it difficult to continuously make cigarettes.

Therefore, an object of the present invention is to provide a cigarette filter wrapper which can suppress the exudation of glue so as to be able to continuously make filter-tipped cigarettes without difficulties, and also can achieve a high ventilation rate.

Another object of the present invention is to provide a cigarette filter wrapped by such a cigarette filter wrapper.

Still another object of the present invention is to provide a cigarette having such a cigarette filter.

BRIEF SUMMARY OF THE INVENTION

According to a first aspect of the present invention, there is provided a cigarette filter wrapper paper comprising a plurality of layers or plies which are integrally combined together and having a first surface and a second surface, the filter wrapper paper exhibiting a first overlap air permeability, measured when a perforated tip paper is overlapped on the first surface, and a second overlap air permeability, measured when a perforated tip paper is overlapped on the second surface, the first overlap air permeability being higher than the second overlap air permeability.

In the present invention, it is preferable that the first overlap air permeability should be 1.5 times or more higher than the second overlap air permeability.

In the present invention, it is desirable that the layer or ply which provides the first surface should have a single-layer air permeability of, preferably, 10,000 CORESTA units or more, and more preferably, 30,000 CORESTA units or more, and the layer or ply which provides the second surface should have a single-layer air permeability lower than that of the layer which provides the first surface, in a range of, preferably, 1800 to 2,5000 CORESTA units.

In the present invention, the layer or ply which provides the first surface should preferably have a single-layer thickness of 30 to 100 $\mu$m, and the layer or ply which provides the second surface should preferably have a single-layer thickness of 15 to 35 $\mu$m.

Further, the wrapper paper of the present invention should preferably have a total air permeability of 1500 to 15000 CORESTA units, and should preferably have a total thickness of 40 to 130 $\mu$m.

According to the second aspect of the present invention, there is provided a cigarette filter wrapping paper comprising a paper sheet having a first surface and a second surface, the filter wrapper paper exhibiting a first overlap air permeability, measured when a perforated tip paper is overlapped on the first surface, and a second overlap air permeability, measured when a perforated tip paper is overlapped on the second surface, the first overlap air permeability being 1.5 times or more higher than the second overlap air permeability.

According to the third aspect of the present invention, there is provided a cigarette filter wrapped by the wrapper paper of the present invention such that the first surface of the wrapper paper faces outwards.

According to the fourth aspect of the present invention, there is provided a filter-tipped cigarette comprising a tobacco portion and a filter portion which are connected to each other with a tip paper having a plurality of ventilation holes, the filter-tipped cigarette having a filter section wrapped (directly or indirectly) by the wrapper paper of the present invention disposed such that the first surface faces outwards, at a position corresponding to the ventilation holes.

In the present invention, the overlap air permeability refers to an air permeability when air is allowed to pass through the wrapper paper from a perforated tip paper overlaid on the wrapper paper.

In the present invention, the single-layer air permeability refers to an air permeability of each individual sheet of paper when the layers which constitute wrapper paper are individually formed into individual single sheets, respectively, without combining them with each other. Further, in the present invention, the single-layer thickness refers to a thickness of each individual sheet when the layers which constitute wrapper paper are individually formed into individual single sheets, respectively, without combining them with each other.

In the present invention, the total air permeability of the wrapper paper refers to an air permeability of the entire wrapper paper measured without overlaying tip paper.

In the present invention, the first surface and the second surface of the wrapper paper refers to the two surfaces of the wrapper paper, extending in the direction intersecting the thickness direction of the wrapper paper.

In the present invention, any of the air permeability values are measured in accordance with the method specified in ISO 2965.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
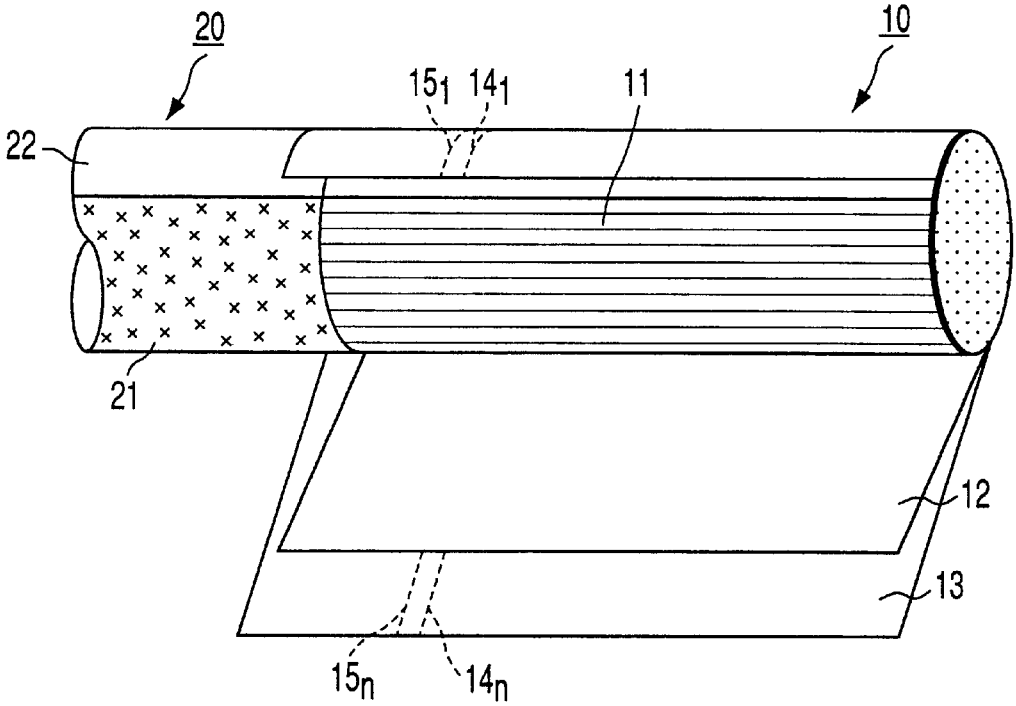
FIG. 1 is a partially cut-out and developed perspective view showing a filter-tipped cigarette according to one embodiment of the present invention.

The present invention will now be described in detail with reference to accompanying drawings. Throughout the drawings, the same or similar elements are designated by the same reference numerals if appropriate.

FIG. 1 is a perspective view showing the basic structure of a filter-tipped cigarette of the present invention, with a part of its tobacco portion being cut out, with the wrapper paper and tip paper, which will be described later, developed. The filter-tipped cigarette has a similar structure to an ordinary filter-tipped cigarette except for the structure of the wrapper paper of the filter section.

The filter-tipped cigarette shown in FIG. 1 has a tobacco portion 20 including a tobacco column 21, which is composed of a columnar (usually cylindrical as shown in FIG. 1) tobacco filler material, and an ordinary cigarette wrapper 22 which wraps the tobacco column 21. A filter portion 10 is connected to an end of the tobacco portion 20. The tobacco filler material is an ordinary tobacco filler material such as cut tobacco or expanded cut tobacco.

The filter portion 10 has a filter body 11 composed of at least one filter section. The filter body 11 can be made of an ordinary tobacco filter material such as cellulose acetate fiber. The filter body 11 is wrapped with a filter wrapper paper 12 of the present invention. The wrapper paper 12, when developed, has the same width as the length of the filter body 11 in its axial direction. That is, the wrapper paper 12 covers the outer circumference of the filter body 11 in just proportion, and both end portions thereof are overlapped and glued.

The tobacco portion 20 and the filter portion 10 are integrally connected by being wrapped with a perforated tip paper 13 having a plurality of ventilation holes provided therein. The tip paper 13 covers the entire outer circumference of the wrapper paper 12, and also covers the proximal end portion of the cigarette wrapper 22 of the tobacco portion 20. In other words, the perforated tip paper 13 extends from the wrapper paper 12 onto the cigarette wrapper 22 such as to cover the proximal end portion of the cigarette wrapper 22. The perforated tip paper 13 may be made of any paper material ordinarily used as tip paper.

The tip paper 13 has a plurality of ventilation holes perforated at a position distant from the proximal end (an opposite end side to the tobacco portion 20, that is, a smoking end) of the filter portion 10. The ventilation holes can be made by means known in the art, such as laser perforation means, mechanical perforation means or electrostatic perforation means. These ventilation holes are made to be arranged in line in its circumferential direction when the tip paper 13 is wrapped around the filter portion 10. It is preferable that 1 to 4 ventilation hole lines should be provided.

More specifically, FIG. 1 shows a large number of ventilation holes $\mathbf{14}_1$ to $\mathbf{14}_n$ constituting a first line, made by the laser perforation, and a large number of ventilation holes $\mathbf{15}_1$ to $\mathbf{15}_n$ constituting a second line which is at a distance of, for example, from 0.5 mm to 1.5 mm away from the first line. (This distance is the distance between the centers of the lines, i.e., between the line connecting the centers of the first line holes and the line connecting the centers of the second line holes are linked.) The diameter of each of the ventilation holes may be, for example, from 0.01 mm to 0.4 mm. The number of the ventilation holes in each of the lines may be, for example, 20 to 200. It is sufficient that the air permeability of the tip paper 13 itself is about 200 to 5000 CORESTA units.

In the prior art, the two overlapped sheets of paper wrapping the filter (that is, the respective individual filter wrappers for wrapping the respective filter sections, and the integral filter wrapper) are composed of two papers having the same air permeability. However, the present inventors have examined the total air permeability of both wrappers placed on upon the other with the air permeability of the wrappers changed. As a result, in both cases of arranging the integral filter wrapper having a high air permeability at the upstream side of air flowing-in from the ventilation holes (at the outside) and the filter wrapper having a low air permeability at the downstream side thereof (at the inside), and contrarily of arranging the integral filter wrapper having a low air permeability at the outside and the filter plug wrapper having a high air permeability at the inside, the total air permeability of the both wrappers placed one upon the other was determined by the wrapper having a low air permeability, as expected. Therefore, it was expected in the both cases that the ventilation amount (the ratio of air flowing-in from the ventilation holes and passing through the filter wrapper and the integral filter wrapper into cigarette smoke) should be governed by the wrapper having a low air permeability.

However, the present inventors have wrapped a filter by two wrappers having different air permeability values, and wrapped this filter together with a tobacco portion by a perforated tip paper to provide a filter-tipped cigarette, and measured its ventilation amount. As a result, surprisingly, the present inventors have found that the ventilation amount in the case of arranging the wrapper having a lower air permeability at the inside is different from that in the case of arranging the same wrapper at the outside. More specifically, the present inventors have found that the cigarette wherein the wrapper having a high air permeability is arranged at the outside has a significantly higher ventilation amount than that wherein the same wrapper is arranged at the inside. This finding is entirely contrary to the inventor's expectation. The present invention is based on this finding.

On the basis of the aforementioned finding, the present inventors have made further investigation, in consideration of the problem of exudation of glue, which occurs when a wrapper paper having a high air permeability is used, and consequently have found that an excellent ventilation amount can be achieved and at the same time, the problem of the exudation of glue can be solved by combining the wrapper paper of the filter body as a multi-layer or -ply combination structure having a high-permeability layer and a low-permeability layer on both surfaces. Such a wrapper paper exhibits a first overlap air permeability when measured, with a perforated tip paper overlaid on one surface (the first surface), and a second overlap air permeability when measured, with the perforated tip paper overlaid on another surface (the second surface). The wrapper paper can be characterized by the fact that the first overlap air permeability is higher than the second overlap air permeability. In the wrapper paper having the multi-ply combination structure, it is particularly preferable that the first overlap air permeability should be 1.5 times or more higher than the second overlap air permeability.

In the present invention, when the first overlap air permeability should be 1.5 times or more higher than the second overlap air permeability, the wrapper paper does not necessarily have to have a multi-layer combination structure, but may be of a single-layer structure. Such a wrapper paper having a single-layer structure in which the first overlap air permeability is 1.5 times or more higher than the second overlap air permeability may be, for example, a single-layer wrapper paper having a gradient in its porosity.

In the present invention, the overlap air permeability is measured in the following manner. That is, a perforated tip paper and wrapper paper are overlaid one on another such that the perforated tip paper is situated on an upstream side of the air flow, and the wrapper paper is situated on a downstream side of the air flow, and the permeability is measured by the method defined by ISO 2965. The tip paper used for the measurement has 2 lines of ventilation holes made with a laser. The average diameter of the ventilation holes is 0.13 mm, the number of ventilation holes in a length of 10 mm in each of the lines of the ventilation holes is 20, and the distance between the ventilation hole lines is 1.5 mm. When the overlap air permeability is measured using an air permeability meter available from Filtrona Co., Ltd., it requires more time to stabilize the permeability value than the case where the permeability of a sheet of paper is measured in an ordinary way. More specifically, in that case, the value measured after 3 minutes or more from the start of the measurement performed after a sample to be measured is mounted in the air permeability meter is taken as a overlap air permeability.

As can be understood from the above description, the wrapper paper 12 of the present invention wraps the filter body such that the first surface is brought into contact with the perforated tip paper 13. In other words, the wrapper paper 12 of the present invention wraps the filter body 11 such that the first surface thereof is situated on the upstream side in view of the air flow entering from the tip paper holes (to be called simply as the upper stream side), and accordingly the second surface is situated on the downstream side. In this case, when the wrapper paper 12 is glued, the glue is applied on the second surface.

Figure 2:
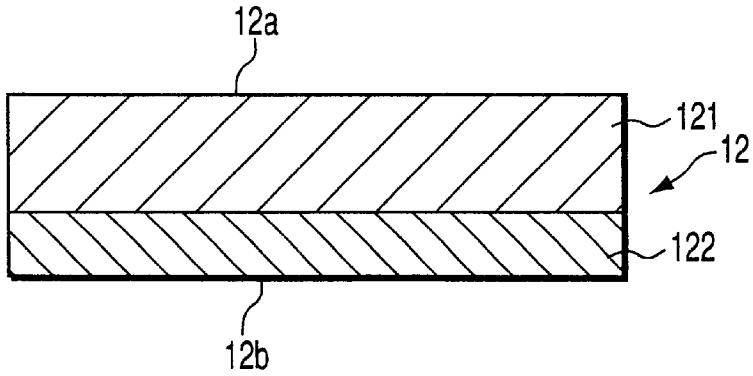
FIG. 2 is a cross sectional view showing a wrapper paper according to one embodiment of the present invention.

FIG. 2 shows an example of a wrapper paper having a multi-ply combination structure, of the wrapper paper 12 of the present invention.

The wrapper paper 12 having a multi-ply combination structure of the present invention has a layer 121 which provides a first surface 12*a* and a layer 122 which provides a second surface 12*b* are combined into an integral combination structure. FIG. 2 shows a wrapper paper 12 of a 2-ply combination structure.

In the wrapper paper 12, the first overlap air permeability measured, with a perforated tip paper (not shown) overlaid on the first surface 12*a*, is higher than the second overlap air permeability measured, with a perforated tip paper (not shown) overlaid on the second surface 12*a*. As long as this condition is satisfied, the wrapper paper having a multi-ply combination structure is not limited to a 2-ply structure, but may be of a multi-ply structure of three layers or more. Preferably, the first overlap air permeability should be 1.5 times or more, and more preferably 2 times or more, higher than the second overlap air permeability. Usually, the ratio between the first overlap air permeability/the second overlap air permeability is 6.0 or less. As mentioned before, in the present invention, when the first overlap air permeability is 1.5 times or more higher than the second overlap air permeability, the wrapper paper 12 may be of a single-layer structure. In that case as well, it is particularly preferable that the first overlap air permeability should be two times or more higher than the second overlap air permeability.

Returning to FIG. 2, the layer 121 which provides the first surface (to be called "high permeability layer" in some cases for convenience) is made bulky and has a relatively large pore diameter within the sheet in order to have a very high permeability. Here, the sheet density should preferably be in a range of 0.2 to 0.35 g/cm$^3$. As fibers which form the high permeability layer 121, fibers for obtaining a high bulkiness, fibers for obtaining a good machineability and optionally fibers for creating bonds between fibers are used in combination in various ways. Examples of the fibers for obtaining bulkiness are semi-synthetic fibers such as rayon and lyocell synthetic fibers such as acetate, nylon, vinylon, acryl, polyester (PET), polyethylene (PE), polypropylene (PP) fibers and composite fibers of these, as well as synthetic fibers having a curling property. Of these fibers, there are those which exhibit an adhesivity between fibers due to heat in a drying zone of the paper machine. As these fibers, those having a fineness of 1 to 20 deniers can be used, and preferably those having 2 to 5 deniers should be used. Further, of natural fibers ordinarily used for paper manufacturing, such as wood pulp and non-wood pulp, it is possible to use a non-wood fiber pulp which can easily obtain bulkiness, for example, pulp fibers such as manila hemp, sisal hemp, kenaf, esparto and rosel, or wood pulp such as of thick-walled south-sea wood pulp or thick-walled coniferous tree pulp, solely or in combination of two or more. These natural fibers, when used in combination with the above-described semi-synthetic fibers or synthetic fibers, will have a high paper-making property, which is preferable. If necessary, fibers which create inter-fabric bonds, such as polyvinylalcohol (PVA)-based binder fibers, composite fibers or thermo-plastic synthetic fibers are used in a small amount. The high permeability layer 121 can be tanmo-machined or cylinder machined; however it is preferable that the tanmo-machine paper making should be used in order to obtain bulkiness.

The layer 122 which provides the second surface (to be called "low permeability layer" in some cases for convenience) has a smaller pore diameter as compared to that of the high permeability layer 121, and has a higher density than that of the high permeability layer 121. It is preferable that the sheet density should be in a range of 0.3 to 0.6 g/cm$^3$. The low permeability layer 122 serves as a layer for preventing the exudation of glue through the wrapper paper while manufacturing tobacco filters, and therefore it is necessary that the pore diameter thereof should be made smaller than that of the high permeability layer 121. Therefore, coniferous tree kraft pulp (NBKP), broad-leave tree kraft pulp (LBKP), cotton pulp, linter pulp, flax pulp, or non-wood fiber pulp used for the high permeability layer, such as manila hemp, sisal hemp, kenaf, esparto or rosel is used solely or in combination of two or more. The low permeability layer 122 can be tanmo-machined or cylinder-machined; however it is preferable that the cylinder-machine paper making should be used in order to prevent the exudation of glue through the wrapper paper.

In the present invention, the high permeability layer 121 should preferably have a single-layer air-permeability of 10000 CORESTA units or more, and the low permeability layer 122 should preferably have a single-layer air-permeability in a range of 1800 to 25000 CORESTA units or more, and lower than that of the high permeability layer 121. It is more preferable that the high permeability layer 121 should have a single-layer air-permeability of 30000 CORESTA units or more, whereas it is more preferable that the low permeability layer 121 should have a single-layer air-permeability of ⅔ or less of that of the single-layer air-permeability of the high permeability layer 121, with a single-layer air-permeability of ⅓ or less of that of the single-layer air-permeability of the high permeability layer 121, being particularly preferable. There is no particular upper limit to the single-layer air-permeability of the high permeability layer 121, but the single-layer air-permeability of the high permeability layer 121 is usually 300000 CORESTA units or less.

Further, the high permeability layer 121 should preferably have a single-layer thickness of 30 to 100 $\mu$m, and the low permeability layer 122 should preferably have a single-layer thickness of 15 to 35 $\mu$m.

As noted above, the wrapper paper of the invention having a multi-ply combination structure is preferably combinedly made with a composite paper-making machine having a tanmo paper-making unit and a cylinder paper-making unit. By this combination paper-making, the total thickness of the wrapper paper usually becomes slightly smaller than the total of the single-layer thicknesses of all the plies possibly because the plies are stacked one on another in a wet paper state and then compressed. In the present invention, it is particularly preferable that the wrapper paper 12 should have a total thickness of 40 to 130 $\mu$m.

It is particularly preferable that the wrapper paper 12 of such a multi-ply combination structure having the high permeability layer 121 and the low permeability layer 122 should have a total air-permeability of 1500 to 15000 CORESTA units. The wrapper paper of the present invention exhibits the same total air-permeability if air is allowed to pass through the wrapper paper from the first surface side or if air is allowed to pass through the wrapper paper from the second surface side. It should be noted that even if the total air-permeability is higher, the ventilation amount is not always higher as well.

As mentioned above, the first overlap air permeability exhibited in the case where the perforated tip paper is overlaid on the first surface and air is allowed to flow into the wrapper paper from the perforated tip paper side is significantly different from the second overlap air permeability exhibited in the case where the perforated tip paper is overlaid on the second surface and air is allowed to flow into the wrapper paper from the perforated tip paper side. In the present invention, as the first overlap air permeability becomes higher, the ventilation amount becomes higher accordingly. Therefore, the first overlap air permeability can also be an index for the ventilation ratio.

It should be noted that in the case where the high permeability layer 121 has a sufficiently high air permeability as compared to that of the low permeability layer 122, a dual filter, when ventilation holes are made in the tip paper in two lines, can exhibit a ventilation amount of about 50% or higher.

By having the structure described above, the wrapper paper of the present invention, if used in combination with a perforated tip paper, can achieve an excellent ventilation amount. In addition, in the wrapper paper of the present invention, the glue is applied on the second surface when the overlapped end portions of the wrapper paper is bonded. Therefore, the exudation of the glue can be suppressed, and thus the production of filter-tipped cigarettes can be carried out continuously without any trouble.

It is possible that the wrapper paper of the present invention is coated with or impregnated with a coating agent such as a water-soluble polymer material, in order to improve the paper strength, the surface property and the like. The coating or impregnation can be carried out using a blade coater, a roll coater, a size press or the like. The coating c agent can be selected from materials generally used in paper-making, and the specific examples thereof include polyvinyl alcohol, various starches, carboxylmethylcellulose, sodium alginate, polyacrylate-based polymer, vinyl polyacetate-based polymer, in the form of emulsion. These materials may be used solely or in combination of two or more, and further they can be used together with various water-resisting agents and surface sizing agents. The coating improves on-machine adaptability of the filter wrapper paper and mechanical running adaptability. Further, the fluffiness of the surface and the fall-off of the fibers can be suppressed.

As described above, in the tobacco filter of the present invention, the filter body 11 is composed of one or a plurality of filter sections.

Figure 3:
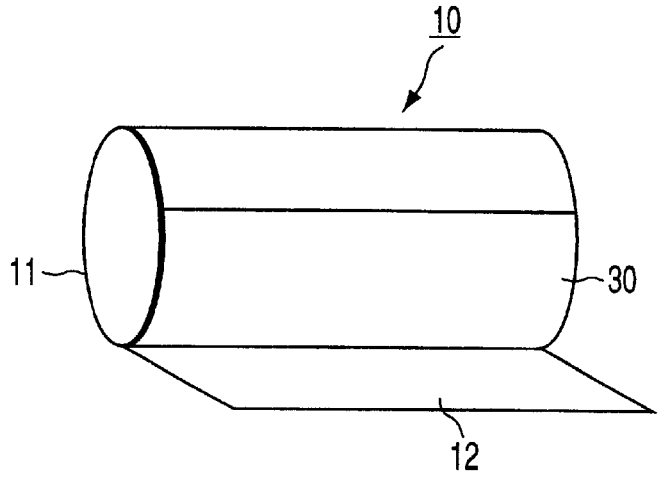
FIG. 3 is a partially developed perspective view showing a cigarette filter according to one embodiment of the present invention.

FIG. 3 shows the filter 10 in which the filter body 11 is composed of one filter section 30, with the wrapping paper 12 developed. The filter section 30 can be made of, for example, cellulose acetate fiber tow, into a so-called plain filter. The outer circumference of the filter section 30 is covered just by the wrapper paper 12 of the present invention. In this case, the low permeability layer 122 (see FIG. 2) of the wrapper paper 12 is brought into direct contact with the filter section 30.

Figure 4:
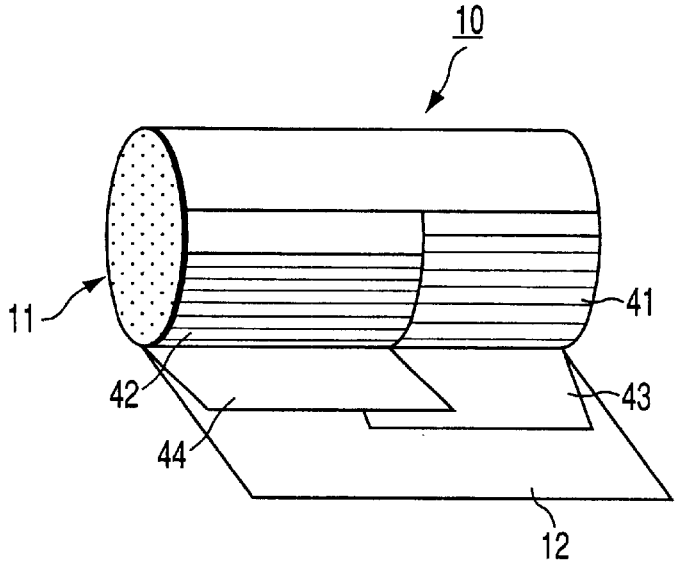
FIG. 4 is a partially developed perspective view showing a cigarette filter according to another embodiment of the present invention.

FIG. 4 shows a filter 10 having a so-called dual filter structure as an example of the filter in which the filter body 11 is composed of a plurality of filter sections, with the wrapper paper 12 or the like developed.

In FIG. 4, the filter 10 includes a filter body 11 consisting of two filter sections 41 and 42. More specifically, the filter body 11 has a so-called dual filter structure having a first filter section 41 serving as an inhalation portion of the cigarette and a second filter section 42 connected coaxially on an upstream side of the tobacco smoke inhaled.

The filter section 41 may have a length in a range of, for example, 5 mm to 25 mm, whereas the second filter section 42 may have a length in a range of, for example, 5 mm to 25 mm. The dual filter body 11 usually has a length of 17 mm to 30 mm, and its diameter (accordingly, the diameters of the filters 41 and 42 as well) may be, for example, 7.0 mm to 8.3 mm.

The first filter section 41 can be constituted by a so-called plain filter made of only an ordinary filter member such as of cellulose acetate fiber or the like. And the second filter section 42 can be made of the ordinary filter material with an adsorbent such as activated carbon dispersed therein. The filter body 11 may usually have an air permeation resistance of about 50 mm $H_2O$ to 150 mm $H_2O$.

The first filter section 41 and the second filter section 42 are wrapped by a first individual wrapping paper 43 and a second individual wrapping paper 44, respectively.

The first individual wrapping paper 43 has the same width as the length of the first filter section 41 in its axial direction when developed, and the second individual wrapping paper 44 has the same width as the length of the second filter section 42 in its axial direction when developed. Therefore, the first individual wrapping paper 43 just covers the outer circumference (the circular circumference in the example shown in the Figure) of the first filter section 41, while the second individual wrapping paper just covers the outer circumference (the circular circumference in the example shown in the Figure).

The filter sections 41 and 42 respectively wrapped by the individual wrapping paper are integrally wrapped by one wrapper paper 12 of the present invention. The wrapper paper 12 has a width the same as the length of the dual filter body 11 in its axial direction, and just covers the circumference (circular circumference in the example shown in the Figure) through the individual wrapping papers 43 and 44. Of the individual wrapping papers 43 and 44, it is sufficient if the air permeability of an individual wrapping paper corresponding to the ventilation holes (see FIG. 1) of the tip paper which is not shown in FIG. 4, (that is, individual wrapping paper located underneath the ventilation holes) is 7000 to 10000 CORESTA units, whereas the individual wrapping paper which does not correspond to the ventilation holes is not particularly limited, and may be of a non-permeation type.

Figure 5:
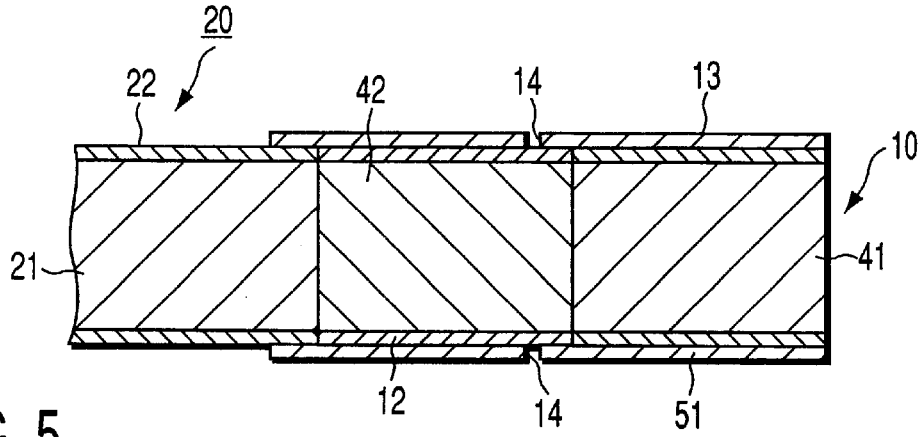
FIG. 5 is a cross sectional view showing a portion of a cigarette filter according to still another embodiment of the present invention.

FIG. 5 shows a cigarette filter, a so-called on-machine dual filter, while it is connected to the tobacco portion by a tip paper. The structure of the on-machine dual filter is similar to that of the usual dual filter shown in FIG. 4 except that the filter sections 41 and 42 are not wrapped with the individual wrapping papers 43 and 44, but the filter section 42 which corresponds to the ventilation holes 14 made in the tip paper 13 which connects the tobacco portion 20 with the filter portion 10 is wrapped directly with the wrapper paper 12 of the present invention, and the filter section 41 which does not correspond to the ventilation holes 14 is wrapped directly with a second wrapping paper 51. The second wrapping paper 51 is not particularly limited, but may be made of the wrapper paper of the present invention, or may be made of a so-called non-permeation paper.

As can be understood from the above description, the cigarette filter of the present invention is intended to be used in combination with a tip paper in which ventilation holes (perforations) are perforated. The filter portion has a filter section wrapped directly or indirectly with the wrapper paper of the present invention arranged such that the high permeability layer faces outwards, at a position corresponding to the perforations of the tip paper. The cigarette filter of the present invention will now be described again briefly with reference to FIG. 1, for example, for the sake of caution. The cigarette filter of the present invention has a filter body 11 consisting of at least one filer section, and the filter body 11 is wrapped with the wrapper paper 12 of the present invention. When the filter is used in combination with the perforated tip paper 13 (that is, when wrapped with the perforated tip paper 13 together with the tobacco portion 20), the wrapping paper 12 is arranged such that the high permeability layer 121 (see FIG. 2) is situated outside, that is, just underneath the tip paper 13.

In the case where the filter body has a dual structure, and if the first filter section individually wrapped by the first individual wrapping paper is represented by A, while the second filter section individually wrapped by the second individual wrapping paper is represented by B, it is a general practice that, a plurality of units of a connected body BAAB are put together and integrated by an integral paper to provide a product (for example, BAABBAAB, BAABBAABBAAB, or the like). In manufacturing the filter-tipped cigarette, this integrated product is firstly cut between the two adjacent filter sections B and B to obtain a plurality of connected bodies BAAB. Then, the tobacco portions 20 are fitted to both B ends of each of the connected bodies, and are connected to both the ends by means of a perforated tip paper. This perforated tip paper has a form in which two pieces of the tip paper 14 shown in FIG. 1 are symmetrically connected to each other at their proximal ends. Subsequently, the tip paper and the integral filter wrapper of the filter connected body whose both ends are connected to the filter portions 20 are cut so that the adjacent filter sections A and A are separated, so as to obtain two filter-tipped cigarettes. This connected body, as well as the filter for a cigarette which is in such a form that the connected bodies are put together, are also within the scope of the present invention.

EXAMPLE 1

A wrapper paper for a cigarette filter of the present invention was manufactured in the following manner.

23 parts by weight of commercially available manila hemp pulp beaten to a Canadian standard freeness of 752 ml CSF; 72 parts by weight of rayon fiber (Daiwa Bou Rayon Co., Ltd. of Japan, Rayon SB (5d×5 mm)); and 5 parts by weight of polyvinylalcohol-based fibrous binder (Kuraray Co., Ltd. of Japan, VPB107 (1d×3 mm)) were mixed together to prepare a paper making material for a high permeability layer.

On the other hand, to a commercially available coniferous tree bleached kraft pulp (NBKP) beaten to a Canadian standard freeness of 286 ml CSF, 72 parts by weight of rayon fiber (Daiwa Bou Rayon Co., Ltd. of Japan, Rayon SB (5d×5 mm)), 0.4% by weight (solid content/solid content) and 0.12% by weight (solid content/solid content) of alkylketen dimmer (AKD)-based resin (Arakawa Chemical Industries Co. Ltd. of Japan, tradename of Size Pine K901) and polyamide resin (Japan PMC Co., Ltd. of Japan, tradename of RD805), respectively, were added to prepare a paper making material for a low permeability layer.

The paper materials of both layers were diluted appropriately, and sent to the tanmo part and cylinder part of a composite paper making machine having such parts. Then, by means of a size press coating device provided in the drying part of the paper making machine, a coating liquid containing 2% by weight of polyvinyl alcohol (DENKI KAGAKU KOGYO Co., Ltd. Of Japan, Denka Size A-50) and 0.1 by weight of polystylene-based resin (ARAKAWA KAGAKU KOGYO Co., Ltd. of Japan, Polymaron 360) serving as a surface sizing agent was applied, thus providing a cigarette filter wrapper paper A of the present invention, having a basis weight of 32.3 g/m$^2$.

EXAMPLE 2

65 parts by weight of commercially available manila hemp pulp used in EXAMPLE 1; and 35 parts by weight of polyester-based binder fiber (Kuraray Co., Ltd. of Japan, Sofit N720 (2d×5 mm)) are mixed together to prepare a paper making material for a high permeability layer.

On the other hand, to a commercially available coniferous tree bleached kraft pulp (NBKP) beaten to a Canadian standard freeness of 314 ml CSF; and 0.4% by weight (solid content/solid content) and 0.12% by weight (solid content/solid content) of alkylketen dimmer (AKD)-based resin (Arakawa Chemical Industries Co. Ltd. of Japan, tradename of Size Pine K901) and polyamide resin (Japan PMC Co., Ltd. of Japan, tradename of RD805), respectively, were added to prepare a paper making material for a low permeability layer.

With use of both paper materials, a cigarette filter wrapper paper B of the present invention, having a basis weight of 35.7 g/m$^2$, was manufactured in the same manner as that of EXAMPLE 1.

EXAMPLE 3

A cigarette filter wrapper paper C of the present invention, having a basis weight of 35.0 g/m$^2$, was manufactured in the same manner as that of EXAMPLE 2 except that the basis weight of the low permeability layer was reduced by 1 g/m$^2$.

EXAMPLE 4

50 parts by weight of commercially available manila hemp pulp beaten to a Canadian standard freeness of 712 ml CSF; 47.5 parts by weight of rayon fiber (Daiwa Bou Rayon Co., Ltd. of Japan, Rayon SB (3d×5 mm)); and 2.5 parts by weight of polyvinylalcohol-based fibrous binder used in EXAMPLE 1 were combined together to prepare a paper making material for a high permeability layer.

On the other hand, to a commercially available coniferous tree bleached kraft pulp (NBKP) beaten to a Canadian standard freeness of 255 ml CSF; 0.4% by weight (solid content/solid content) of alkylketen dimmer (AKD)-based resin (Arakawa Chemical Industries Co. Ltd. of Japan, tradename of Size Pine K901) was added to prepare a paper making material for a low permeability layer.

The paper materials for both layers were diluted appropriately, and sent to the tanmo part and cylinder part of a composite paper making machine having such parts. Then, without having a size press coating unlike in EXAMPLES 1 to 3, a cigarette filter wrapper paper D of the present invention, having a basis weight of 22.0 g/m$^2$ was manufactured.

EXAMPLE 5

16 parts, 79.7 parts and 4.3 parts by weight of manila hemp pulp, rayon fiber and polyvinylalcohol-based fibrous binder used in EXAMPLE 4 were mixed together to prepare a paper making material for a high permeability layer.

On the other hand, a paper making material for a low permeability layer was prepared in a similar manner to that of EXAMPLE 4 except that the Canadian standard freeness of the coniferous tree bleached kraft pulp was 315 ml CSF.

With use of the paper materials for both layers, a cigarette filter wrapper paper E of the present invention, having a basis weight of 23.0 g/m$^2$ was manufactured in the same manner as in EXAMPLE 4.

EXAMPLE 6

41.8 parts, 57.0 parts and 1.2 parts by weight of commercially available manila hemp pulp beaten to a Canadian standard freeness of 703 ml CSF, rayon fiber and polyvinylalcohol-based fibrous binder used in EXAMPLE 4, respectively, were mixed together to prepare a paper making material for a high permeability layer.

On the other hand, a paper making material for a low-.permeability layer was prepared in a similar manner to that of EXAMPLE 4 except that the Canadian standard freeness of the coniferous tree bleached kraft pulp was 261 ml CSF.

With use of the paper materials of both layers, a cigarette filter wrapper paper F of the present invention, having a basis weight of 22.5 g/m$^2$ was manufactured in the same manner as in EXAMPLE 4.

EXAMPLE 7

A cigarette filter wrapper paper G of the present invention, having a basis weight of 22.5 g/m$^2$ was manufactured in the same manner as in EXAMPLE 6 except that the Canadian standard freeness of the coniferous tree bleached kraft pulp for the paper material for the low permeability layer was 300 ml CSF.

EXAMPLE 8

A cigarette filter wrapper paper H of the present invention, having a basis weight of 22.5 g/m$^2$, was manufactured in the same manner as that of EXAMPLE 7 except that the amounts of commercially available manila hemp pulp, rayon fiber and polyvinylalcohol-based fibrous binder were set to 26.2 parts, 72.3 parts and 1.5 parts by weight, respectively.

With regard to each of the wrapper papers A to H manufactured in EXAMPLES 1 to 8, the single-layer air permeability and single-layer thickness of the high permeability layer and the low permeability layer, and the total thickness are summarized in TABLE 1 below. Further, the total air permeability (in CORESTA units (CU)) of the wrapper papers A to H, as well as the first and second overlap air permeability values (CU) measured by the above-described method are presented in TABLE 2. TABLE 2 indicates data on single-layer papers used in Comparative Examples 8 and 9, which will be described later.

It should be noted that the air permeability in each case was measured by the method defined by ISO 2965.

TABLE 1

| Example Wrapper paper | Structure of wrapper paper: High permeability layer: Single-layer air permeability (CU) | High permeability layer: Single-layer thickness (μm) | Low permeability layer: Single-layer air permeability (CU) | Low permeability layer: Single-layer thickness (μm) | Total thickness (μm) |
|---|---|---|---|---|---|
| Example 1 Wrapper paper A | 63000 | 80 | 11000 | 20 | 87 |
| Example 2 Wrapper paper B | 31000 | 80 | 8000 | 22 | 89 |
| Example 3 Wrapper paper C | 31000 | 80 | 12000 | 21 | 87 |
| Example 4 Wrapper paper D | 200000 | 51 | 9900 | 22 | 61 |
| Example 5 Wrapper paper E | 265000 | 64 | 9500 | 23 | 60 |
| Example 6 Wrapper paper F | 123000 | 58 | 20500 | 21 | 65 |
| Example 7 Wrapper paper G | 123000 | 58 | 20500 | 21 | 65 |
| Example 8 Wrapper paper H | 250000 | 64 | 20000 | 22 | 70 |

TABLE 2

| Wrapper paper | Air permeability of wrapper paper: Total air permeability (CU) | First overlap air permeability (CU) | Second overlap air permeability (CU) |
|---|---|---|---|
| Wrapper paper A | 2860 | 711 | 193 |
| Wrapper paper B | 2100 | 449 | 146 |
| Wrapper paper C | 3130 | 532 | 217 |
| Wrapper paper D | 5480 | 722 | 259 |
| Wrapper paper E | 5030 | 859 | 261 |
| Wrapper paper F | 8880 | 861 | 418 |
| Wrapper paper G | 9730 | 878 | 387 |
| Wrapper paper H | 11990 | 974 | 407 |
| Comparative Example 8 (single-layer wrapper paper I)* | 9200 | 633 | 549 |
| Comparative Example 8 (single-layer wrapper paper I) | 31000 | 988 | 988 |

*) The single-layer wrapper paper I of Comparative Example 8 exhibited a difference between the first and second overlap air permeability values, possibly because the coating treatment was applied on one surface.

EXAMPLES 9 TO 16 AND COMPARATIVE EXAMPLES 1 TO 9

Eight wrapper papers manufactured in EXAMPLES 1 to 8 were used as presented in TABLE 3 below so as to manufacture plain filters shown in FIG. 3. With use of these plain filters, filter-tipped cigarettes having a structure shown in FIG. 1 were manufactured according to conventional procedures.

Each of thus manufactured filter-tipped cigarettes had a diameter of 7.9 mm and an entire length of 84 mm. The cut tobacco which constitutes its tobacco column 21 is blended cut tobacco of a regular product, and its filling density was 235 mg/cm$^3$. The air permeability of the cigarette paper 22 was 35 CU. Further, the filter had a length of 25 mm, and was made of 2.2Y40000 cellulose acetate fiber tow. Its air permeation resistance was 128 mm $H_2O$ when inhaled at 17.5 ml/sec.

As the tip paper 13, one which has two lines of ventilation holes made therein was used. The number of effective ventilation holes in each line was 46. The center of the ventilation hole lines were located 13.5 mm away and 15 mm away from the proximal end of the filter (inhalation end). The air permeability of the tip paper 13 itself was 1230 CU.

With the filter-tipped cigarettes thus obtained, they were smoked from the filter end side using a predetermined measurement device (automatic air permeability meter AVM of Filtrona Co., Ltd.), so as to measure the flow-in amount of ambient air from the ventilation holes, which is called ventilation amount (Vf). The standard deviation and variation coefficient of the values obtained were also presented in TABLE 3.

It should be noted that when manufacturing each filter, both end portions of the wrapper paper were overlapped when glued up. When gluing, a colored glue (hot melt) was used so as to check if there was any glue exuded onto the surface of the filter plug. For each Example, 300 filter plugs having a length of 10 cm were wrapped with wrapper papers, and the number of plugs having the exudation of glue out of 300 filters were counted by eye.

Further, FIG. 3 shows the results with regard to a filter-tipped cigarette which uses, as its wrapper paper, a single-layer paper having an air permeability of 9200 CU (single-layer wrapper paper I) and a single-layer paper having an air permeability of 310000 CU (single-layer wrapper paper II).

TABLE 3

Ventilation amount and exudation of glue (single filter)

| | Wrapper paper and arrangement | Ventilation amount (%) | Standard deviation (%) | Variation coefficient (%) | Number of samples having exudation of glue out of 300 cigarettes |
|---|---|---|---|---|---|
| Example 9 | Wrapper paper A: High permeability layer upstream side | 65 | 2.3 | 3.5 | 5 |
| Comparative Example 1 | Wrapper paper A: High permeability layer downstream side | 53 | 4.5 | 8.5 | — |
| Example 10 | Wrapper paper B: High permeability layer upstream side | 60 | 2.6 | 4.3 | 8 |
| Comparative Example 2 | Wrapper paper B: High permeability layer downstream side | 48 | 2.8 | 5.8 | — |
| Example 11 | Wrapper paper C: High permeability layer upstream side | 63 | 2.4 | 3.8 | 7 |
| Comparative Example 3 | Wrapper paper C: High permeability layer downstream side | 53 | 3.4 | 6.4 | — |
| Example 12 | Wrapper paper D: High permeability layer upstream side | 67 | 2.6 | 3.9 | 24 |
| Comparative Example 4 | Wrapper paper D: High permeability layer downstream side | 58 | 3.2 | 5.5 | — |
| Example 13 | Wrapper paper E: High permeability layer upstream side | 70 | 2.7 | 3.8 | 15 |
| Comparative Example 5 | Wrapper paper E: High permeability layer downstream side | 62 | 3.0 | 4.9 | — |
| Example 14 | Wrapper paper F: High permeability layer upstream side | 72 | 2.0 | 2.8 | 36 |
| Comparative Example 6 | Wrapper paper F: High permeability layer downstream side | 69 | 2.5 | 3.7 | — |
| Example 15 | Wrapper paper G: High permeability layer upstream side | 74 | 2.0 | 2.8 | 46 |
| Comparative Example 7 | Wrapper paper G: High permeability layer downstream side | 70 | 2.7 | 3.8 | — |
| Example 16 | Wrapper paper H: High permeability layer upstream side | 76 | 1.8 | 2.4 | 24 |
| Comparative Example 8 | Single-layer wrapper paper I | 65 | 3.2 | 4.9 | 67 |
| Comparative Example 9 | Single-layer wrapper paper II | 74 | 1.9 | 2.5 | 166 |

As can be understood from the results presented in TABLE 3, with the present invention (EXAMPLES 9 to 16), substantially the same ventilation amount can be achieved as that of the case where the conventional high air permeability single-layer wrapper paper (single-layer wrapper papers I and II) is used, and its variation coefficient is small. Further, in EXAMPLES 9 to 16, the exudation of glue in the wrapper paper was less, and therefore there were no trouble in making cigarettes continuously.

EXAMPLES 17 to 19 and COMPARATIVE EXAMPLE 10

Filter-tipped cigarettes having a structure similar to that of EXAMPLES 9 to 16 were manufactured except that the filter body 11 was of a dual filter structure shown in FIG. 4.

In the dual filter structure, the length of the plain filter (the filter section 41 in FIG. 4) situated at the proximal end portion and made of 2.2Y4000 cellulose acetate fiber tow was 10 mm, the air-permeation resistance when inhaled at 17.5 ml/sec was 50 mm $H_2O$, the length of the filter (the second filter section 42 in FIG. 4) connected thereto and similarly made of 2.2Y4000 cellulose acetate fiber tow was 15 mm, and the air-permeation resistance when inhaled at 17.5 ml/sec was 76 mm $H_2O$. The other specifications and the measurement results were as presented in TABLE 4.

TABLE 4

Ventilation amount (dual filter)

| | Wrapping paper and arrangement | Individual wrapper paper | Ventilation amount (%) | Standard deviation (%) | Variation coefficient (%) |
|---|---|---|---|---|---|
| Example 17 | Wrapper paper A: High permeability layer upstream side | Air permeability of 10000 CU single layer | 61 | 2.5 | 4.1 |
| Example 18 | Wrapper paper B: High permeability layer upstream side | Air permeability of 10000 CU single layer | 54 | 3.0 | 5.6 |
| Example 19 | Wrapper paper C: High permeability layer upstream side | Air permeability of 10000 CU single layer | 60 | 1.7 | 2.8 |
| Comparative Example 10 | Air permeability of 10000 CU single layer | Air permeability of 30000 CU single layer | 64 | 4.6 | 7.2 |

From the results presented in TABLE 4, it can be understood that according to the present invention, a ventilation amount substantially similar to that of COMPARATIVE EXAMPLE 10 can be achieved (especially, in the cases of EXAMPLES 17 and 19) even a dual filter structure is employed. Further, in EXAMPLES 17 to 19, the exudation of glue in the wrapping paper was not observed, and therefore there were no trouble in making cigarettes continuously.

As described above, with use of the wrapper paper of the present invention, unexpectedly, a further improvement of the ventilation amount can be achieved when it is combined with a perforated tip paper, and therefore the taste of the tobacco can be made milder. Further, with the filter of the present invention, a desirable improvement of the ventilation amount can be achieved without increasing the number of lines of ventilation holes. Further, with the wrapper paper of the present invention, the exudation of glue can be suppressed, and therefore filter-tipped cigarettes can be made continuously without any trouble.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cigarette filter wrapper paper having a multi-ply combination structure in which a plurality of layers are integrally combined together, and having a first surface and a second surface, said filter wrapper paper exhibiting a first overlap air permeability, measured when a perforated tip paper is overlapped on the first surface, and a second overlap air permeability, measured when a perforated tip paper is overlapped on the second surface, said first overlap air permeability being 1.5 times or more higher than the second overlap air permeability.

2. The cigarette filter wrapper paper according to claim 1, wherein a layer which provides the first surface has a single-layer air permeability of 10,000 CORESTA units or more, and a layer which provides the second surface has a single-layer air permeability lower than that of the layer which provides the first surface, in a range of 1800 to 2,5000 CORESTA units.

3. The cigarette filter wrapper paper according to claim 2, wherein a layer which provides the first surface has a single-layer air permeability of 30,000 CORESTA units or more.

4. The cigarette filter wrapper paper according to claim 1, wherein a layer which provides the first surface has a single-layer thickness of 30 to 100 $\mu$m.

5. The cigarette filter wrapper paper according to claim 1, wherein a layer which provides the second surface has a single-layer thickness of 15 to 35 $\mu$m.

6. The cigarette filter wrapper paper according to claim 1, which exhibits a total air permeability of 1500 to 15000 CORESTA units.

7. The cigarette filter wrapper paper according to claim 1, which has a total thickness of 40 to 130 $\mu$m.

8. A cigarette filter wrapped with a wrapper paper according to claim 1, such that the first surface of the wrapper paper faces outwards from a filter plug.

9. A filter-tipped cigarette in which a tobacco portion and a filter portion are connected to each other with tip paper having a plurality of ventilation holes, said filter-tipped cigarette having a filter section wrapped with the wrapping paper according to claim 1 disposed at a position corresponding to the ventilation holes, such that the first surface faces outwards from a filter plug.

10. The cigarette filter wrapper paper according to claim 1, wherein said multi-ply combination structure is produced through stacking and compression of said plurality of layers in wet state.

11. The cigarette filter wrapper paper according to claim 10, wherein said multi-ply combination structure is produced using a composite paper-making machine having a tanmo paper-making unit and a cylinder paper-making unit.

* * * * *